US007093380B2

(12) United States Patent
Hubscher et al.

(10) Patent No.: US 7,093,380 B2
(45) Date of Patent: Aug. 22, 2006

(54) MOUNTING OF AN ACCESSORY ON AN ATV

(75) Inventors: Darin Hubscher, Swan River (CA); Jon Close, Elie (CA)

(73) Assignee: Quadivator Inc., Portage-la-Prairie (CA)

( * ) Notice: Subject to any disclaimer, the term of this patent is extended or adjusted under 35 U.S.C. 154(b) by 90 days.

(21) Appl. No.: 10/969,237

(22) Filed: Oct. 21, 2004

(65) Prior Publication Data

US 2006/0086008 A1 Apr. 27, 2006

(51) Int. Cl.
*A01B 59/00* (2006.01)
*E01H 5/04* (2006.01)

(52) U.S. Cl. ..... 37/231; 172/679

(58) Field of Classification Search ..... 37/231, 37/468; 172/605, 677–681; 280/186
See application file for complete search history.

(56) References Cited

U.S. PATENT DOCUMENTS 3,688,847 A 9/1972 Deeter
4,577,712 A 3/1986 Foote et al.
4,615,130 A 10/1986 Racicot
5,381,647 A 1/1995 Eberle
6,178,668 B1 1/2001 Gustafson et al.
6,502,334 B1 1/2003 Davies
6,557,330 B1 5/2003 Hubscher

*Primary Examiner*—Christopher J. Novosad
(74) *Attorney, Agent, or Firm*—Adrian D. Battison; Michael R. Williams; Ryan W. Dupuis

(57) ABSTRACT

An ATV has an accessory mounted at a front end providing a working tool, such as a blade, brush or snow blower, by a frame which extends underneath the ATV from a hitch coupling at the rear to a mounting plate which is clamped up under the belly pan of the ATV by a pair of straps at the front. The plate can be adjusted in height and position along the frame and can tilt front to rear to accommodate different makes of machine. The tilting can accommodate tilting of the frame if it is carried at the rear on wheels and floating relative to the hitch. The working tool is mounted on a stub frame portion pivotal upwardly and downwardly at the front of the frame. The working accessory can be adjusted side to side to change angle by a manually operable screw which drives a gear on the tool.

30 Claims, 8 Drawing Sheets

MOUNTING OF AN ACCESSORY ON AN ATV

This invention relates to an accessory for mounting on an ATV.

BACKGROUND OF THE INVENTION

Many different arrangements have been provided for attachment of accessories to an ATV type vehicle since such vehicles provide a convenient power plant for moving various accessories and avoid the necessity for a dedicated machine for each accessory. In recent years ATV type vehicles have achieved considerable market penetration and have dramatically improved in construction and features.

A number of examples of such mounting arrangements are shown in the following U.S. patents:

U.S. Pat. No. 3,688,847 (Deeter) issued Sep. 5, 1972 shows a blade on a six wheel skid-steer type vehicle used at that time which has since become obsolete. In this system there is provided a bar supporting the blade at its forward end and extending under the vehicle from a rear coupling at the hitch of the vehicle to a pair of front couplings which extend from brackets at the front wheels diagonally to the front end of the bar. This type of attachment is only applicable to the six wheel type vehicle for which it is proposed and has no suitability in the current four wheel front wheel steering type of vehicle which is common today.

U.S. Pat. No. 4,615,130 (Racicot) issued Oct. 7, 1986 provides a similar arrangement with a pair of parallel rails connected at the rear to the hitch and at the front to an angle iron bolted to the front bumper. This arrangement is designed for use with four wheel cycle type ATVs but is limited in its ability to mount to different makes of the ATV due to the specific locations of the mounting points. The blade can be pivoted side to side to provide an angle to the left or the right by selecting adjustment holes for a spring pin.

U.S. Pat. No. 6,178,668 (Gustafson) issued Jan. 30, 2001 discloses a mounting for a snow blower or other similar driven devices at the front of an ATV type vehicle where the device is driven by an engine mounted at the rear of the vehicle and carried on a frame which extends from the hitch at the rear underneath the vehicle to caster wheels at the front where the device is located. The frame is formed in two sections where the rear section is attached first and is located on the hitch and on pegs underneath the vehicle and the front section is attached to the rear section to connect and drive shaft and to drive the front section forwardly by the rear section while the weight of the front section is carried on its caster wheels. The design is specifically proposed for a Polaris manufactured ATV and thus is unsuitable to attach to alternative makes of ATV.

U.S. Pat. No. 5,381,647 (Eberle) issued Jan. 17, 1995 shows a mower which is carried at the front of the vehicle on a frame which is mounted underneath the vehicle on bolts in suitable formed bolt holes in the vehicle. This arrangement is unsuitable since it requires drilling.

U.S. Pat. No. 6,502,334 (Davies) issued Jan. 7, 2003 shows a blade mounted on a rigid frame having two diverging rails which are bolted at the rear to lugs on the underside of the vehicle and carried on a cable at the front which is hooked onto a suitable member of the vehicle above the frame. This arrangement requires the provision of suitable lugs on the vehicle which are not generally available and thus must be attached by the user. The blade can pivot side to side on a front pivot pin controlled by spring pin.

U.S. Pat. No. 4,577,712 (Foote) issued Mar. 25, 1986 discloses a mower located underneath the vehicle which is carried on wheels and suspended on straps attached to the vehicle frame.

U.S. Pat. No. 6,577,330 of the present inventor issued May 6, 2003 discloses a mower located underneath the vehicle which is supported at the rear end on the hitch at which there is provided an engine for driving the mower and carried at the forward end underneath the vehicle on wheels and is prevented from side to side movement by chains attached to the vehicle frame at a suitable location above the mower. The disclosure of this patent is incorporated herein by reference for any additional details of a machine of this type which may be omitted herein.

PCT published Application WO 02/26023 (De Thomasis) published Apr. 4, 2002 discloses a similar and related arrangement of a mower located underneath the vehicle with an engine for driving the mower at the rear and carried at the forward end underneath the vehicle on wheels and is prevented from side to side movement by straps attached to the vehicle frame at a suitable location above the mower. In this arrangement the rear end is not supported by the hitch but is instead carried on wheels. The disclosure of this patent is incorporated herein by reference for any additional details of a machine of this type which may be omitted herein.

SUMMARY OF THE INVENTION

It is one object of the invention to provide an accessory for mounting on an ATV which allows possible advantages in mounting and operation.

According to one aspect of the invention there is provided an accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a working member attached at the forward end of the frame member so as to be at least partly supported thereby in front of the vehicle for operating in a working action in front of the vehicle;

a hitch coupling at the rearward end of the frame member for attachment to the hitch;

a mounting plate for engaging the belly pan;

a lifting arrangement attached to the frame member in front of the mounting plate and including coupling members thereon for engaging a fixed location on the vehicle at a position thereon at the front thereof and above the mounting plate and lifting elements for applying a pulling force from the coupling members to the frame member to pressure the mounting plate against the belly pan.

The term "frame member" used above is not intended to limit the construction to a single beam since it may include multiple longitudinal members and may include cross members and many different constructions are possible.

Preferably the mounting plate is fixed to the frame member against side to side tilting movement relative thereto and the mounting plate is arranged to engage the belly pan at at least two transversely spaced locations or to lie flat against the pan to prevent side to side twisting of the frame member.

Preferably the lifting arrangement includes two transversely spaced lifting elements each having a respective coupling member and each arranged on a respective side of the mounting plate so that the upward pulling effect at two locations combined with the contact of the mounting plate holds the structure stable on the ATV.

Preferably the lifting elements comprise straps which include ratchet tightening systems.

Preferably the mounting plate is adjustable fore and aft along the frame member so as to be movable sufficiently to accommodate the different preferred locations for different models of ATV, thus allowing the system to be universal.

Preferably the mounting plate is mounted on the frame member such that the mounting plate can tilt about transverse axis. This can accommodate slightly different angles of pan for different models and can accommodate slight tilting movement if the mounting needs to pivot during use.

Preferably the mounting plate carries a resilient pad on its upper surface.

Preferably the mounting plate has a flat upper surface.

Preferably the frame member at its rear end is supported on ground wheels such the height of the rear end changes relative to the belly pan as the ground height changes.

Preferably the working member is carried on a stub frame portion which is pivotally attached to the frame member for pivotal movement about a transverse axis so as to provide upward and downward movement of the whole of the working member relative to the frame member.

Preferably there is provided a coupling on the working member for attachment to a cable of a winch of the vehicle for supporting the working member at a required height.

According to a second aspect of the invention there is provided an all terrain vehicle having a working accessory mounted thereon comprising:

a vehicle having a frame, two front wheels and two rear wheels connected to the frame for supporting the frame in movement over the ground;

an engine mounted on the frame generally between the front and rear wheels and along a center line of the vehicle;

a belly pan attached to the frame and extending from a position underneath the engine forwardly to a front end of the vehicle for protecting the engine against impact damage;

and an accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a working member attached at the forward end of the frame member so as to be at least partly supported thereby in front of the vehicle for operating in a working action in front of the vehicle;

a hitch coupling at the rearward end of the frame member for attachment to the hitch;

a mounting plate for engaging the belly pan;

a lifting arrangement aft ached to the frame member in front of the mounting plate and including coupling members thereon for engaging a fixed location on the vehicle at a position thereon at the front thereof and above the mounting plate and lifting elements for applying a pulling force from the coupling members to the frame member to pressure the mounting plate against the belly pan.

According to a third aspect of the invention there is provided an accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a transverse blade attached at the forward end of the frame member so as to be at least partly supported thereby in front of the vehicle for operating in a working action in front of the vehicle;

a coupling at the rearward end of the frame member for attachment to the vehicle;

a mounting assembly for fixedly mounting the frame member on the vehicle at a position forwardly of the rear end such that the forward end of the frame member is fixed relative to the vehicle;

a stub frame portion extending forwardly from the frame member for supporting the blade;

a housing attached to a rear of the blade, the housing having a top plate and a parallel bottom plate with the stub frame portion located therebetween;

a forward end of the stub frame portion being pivotally connected to a forward end of the housing for pivotal movement of the bade in a side to side direction to change an angle of the blade relative to a direction along a center line of the vehicle;

a rear end of the housing having mounted thereon an adjustment mechanism for locating the rear end of the housing relative to the stub frame portion to set the angle of the blade.

Preferably the stub frame portion is pivotal relative to the frame member about a horizontal transverse axis.

Preferably there is provided a coupling on one of the blade and the housing for attachment to a cable of a winch of the vehicle for supporting the blade at a required height.

Preferably the stub frame portion includes a rear section which is inclined downwardly and forwardly such that the housing is lower than the frame member.

Preferably the adjustment mechanism includes a screw which is operable by the rider of the vehicle and a gear drive for driving the pivotal movement of the housing relative to the stub frame portion.

According to a fourth aspect of the invention there is provided an accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a transverse blade attached at the forward end of the frame member so as to be at least partly supported thereby in front of the vehicle for operating in a working action in front of the vehicle;

a coupling at the rearward end of the frame member for attachment to the vehicle;

a mounting assembly for fixedly mounting the frame member on the vehicle at a position forwardly of the rear end such that the forward end of the frame member is fixed relative to the vehicle;

and a pair of extension pieces each for attachment to a respective end of the blade so as to extend outwardly from the respective end of the blade and defining a common surface with the blade.

Preferably each extension piece has a top insert and a bottom insert which can slide into a corresponding receptacle on the end of the blade when moved along the common surface.

Preferably there is provided at each end of the blade a flange at right angles to the common surface and spaced inwardly from the edge of the blade and wherein each extension piece includes a mounting bracket projecting inwardly from the extension piece along the back of the blade for attachment to the respective flange.

Preferably there is provided a wear plate at a bottom edge of the blade and wherein each extension piece includes a wear plate which has a length greater than that of the extension piece so as to overlap onto the blade.

According to a fifth aspect of the invention there is provided an accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a working member attached at the forward end of the frame member so as to be at least partly supported thereby in front of the vehicle for operating in a working action in front of the vehicle;

a coupling at the rearward end of the frame member for attachment to the vehicle;

a mounting assembly for fixedly mounting the frame member on the vehicle at a position forwardly of the rear end such that the forward end of the frame member is fixed relative to the vehicle;

the working member being mounted for adjustment movement relative to the frame member;

and an adjustment actuating assembly for actuating movement of the working member comprising:

a screw having a screw mounting for mounting the screw on a part of the vehicle accessible by the rider of the vehicle so as to be manually rotatable by a rider;

an elongate torque member having a first end connected to the screw for communicating rotation from the screw into rotation around a longitudinal axis of the torque member;

and an actuator attached to a second end of the torque member so as to receive the rotation and to actuate the adjustment movement in response thereto.

Preferably the actuator includes a gear wheel driven by the torque member and a driven member driven about its axis by the gear wheel.

Preferably the working member comprises a blade and the actuator adjusts the angle of the blade to the longitudinal center line of the vehicle using a gear drive.

Preferably the working member comprises a snow blower and the actuator adjusts the angular position of a discharge chute of the snow blower around a vertical axis.

According to a sixth aspect of the invention there is provided an accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle to a rearward end of the frame member which is arranged to project rearwardly from the rear end of the vehicle;

a working member attached to the frame member so as to be at least partly supported thereby for operating in a working action with the vehicle;

a mounting assembly for attaching the frame member and the working member on the vehicle at a position forwardly of the rear end such that the forward end of the frame member is fixed relative to the vehicle;

at least one ground wheel on the frame member arranged so as to support the rear end of the frame member from the ground such that the height of the frame member varies relative to the hitch of the vehicle as the ground level changes;

and a hitch coupling at the rearward end of the frame member for attachment to the hitch of the vehicle;

the hitch coupling being adjustable such that the height thereof from the frame member can be adjusted;

and the hitch coupling being arranged to float such that the hitch coupling remains attached to the hitch to provide pulling force thereon while the frame member varies in height relative to the hitch as the ground level changes.

Preferably the at least one ground wheel is located substantially directly under the hitch coupling and forward of the rear end of the frame member.

Preferably there is provided a drive engine mounted on the rear end for driving the working member.

Preferably there are a pair of wheels.

Preferably the frame member is defined by a pair of parallel beams and wherein the wheels are located side by side between the beams.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

A first embodiment of the invention is shown in FIGS. 1 through 6 and comprises accessory for an ATV including a working tool 10 at the forward end for operating on the ground as the ATV moves over the ground together with a mounting assembly 11 for mounting the working tool on the ATV.

The mounting assembly 11 provides a universal mounting system which can be attached to any current model of ATV including those manufactured by Honda, Yamaha, Polaris, Artic Cat, Kawasaki and Bombardier of the type designed for utilitarian function as opposed to the sporting type of ATV.

Figure 2:
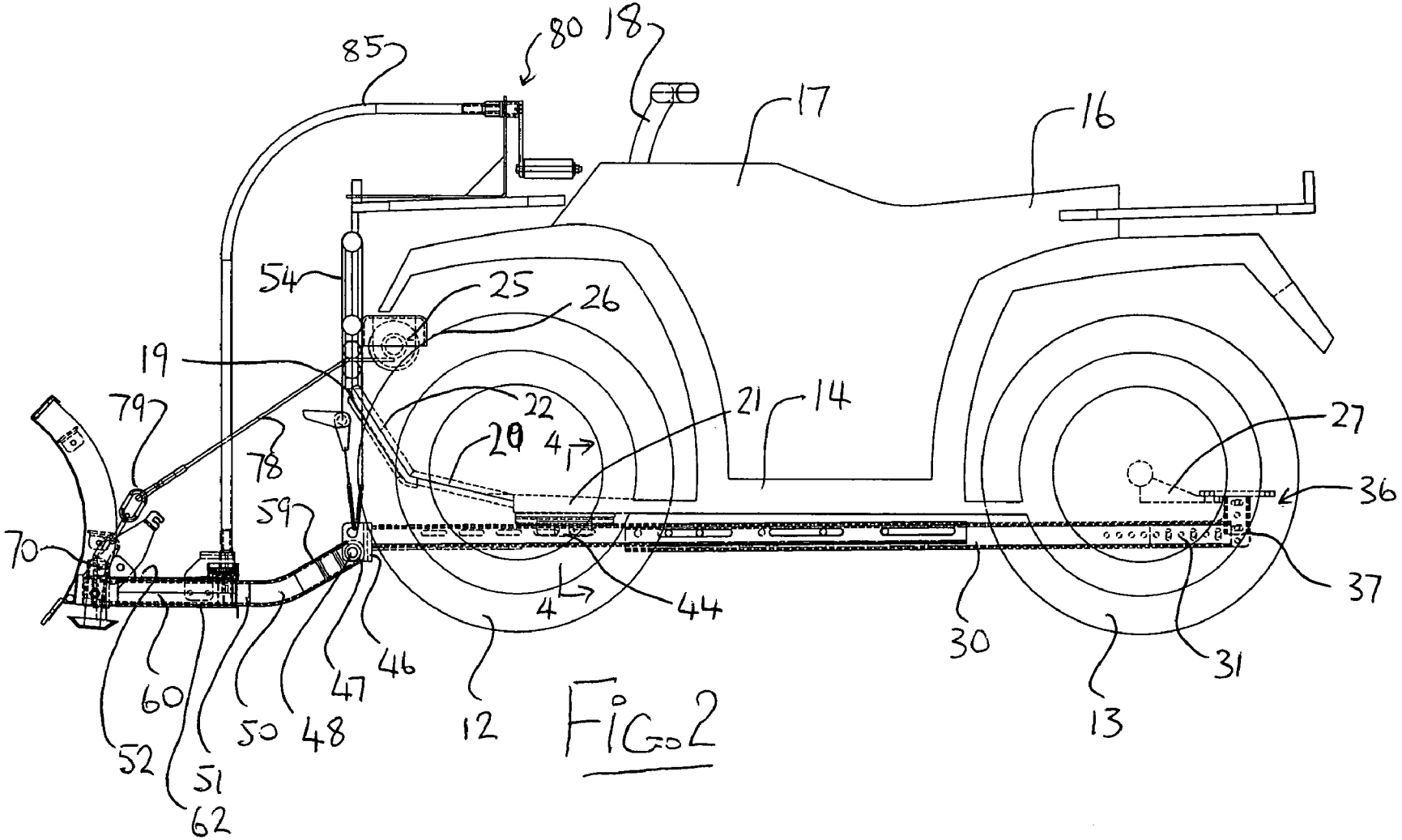
FIG. 2 is a side elevational view of the accessory of FIG. 1 attached to an ATV with the wheels of the ATV omitted for convenience of illustration.

Such vehicles as shown in FIG. 2 include a pair of front wheels 12 and a pair of rear wheels 13. The wheels are mounted on a frame schematically indicated at 14 and commonly the wheels include impendent suspension for the individual four wheels relative to the frame. At the center of the frame is mounted an engine which is carried on the frame and provides drive transmission through a transmission system to either the rear wheels or to both the front and rear wheels as required. The frame carries a seat 16 for the rider together with other accessory including a gas tank 17. The front wheels are steered by a handle bar steering system 18 which turns the front wheels relative to the frame to provide a steering action.

At the front of the frame is provided a bumper 19 which connects to a belly pan or skid plate 20 which extends from the bumper downwardly and rearwardly to a bottom pan portion 21 which is generally horizontal underneath the engine. Such skid plates are commonly used on ATVs to transfer impact forces to the frame rather than to the engine and its mountings in the event of an impact onto rocks or other obstacles. The skid pan forms part of the frame which is defined by a pair of tubes 22 and 23 spaced a part one on either side of a center line of the vehicle with the pan or plate 20 attached across the tubes to form a rigid structure. The pan or plate 20 is generally smooth and smoothly curved from the upwardly and forwardly inclined section at the front of the vehicle to the horizontal section underneath the vehicle so that impact forces are transferred to a sliding action of the vehicle over the obstacle.

The vehicle further includes as conventional optional extras a winch 25 mounted on the front of the vehicle generally on a front pannier or frame 26. Further the vehicle includes as a conventional optional extra, a hitch 27 at the rear of the vehicle attached to the frame behind the rear wheels.

Figure 1:
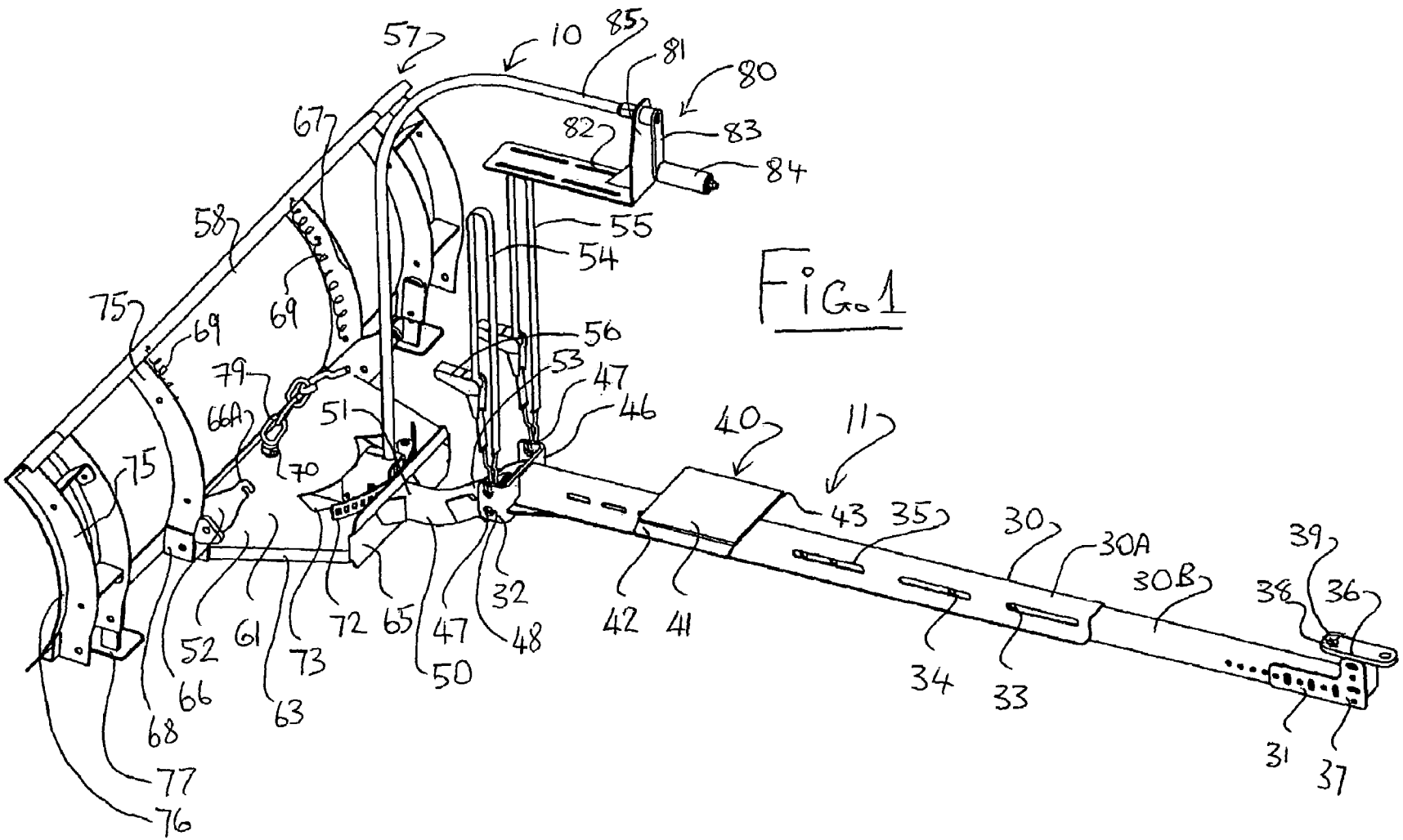
FIG. 1 is an isometric view of a blade accessory and mounting arrangement for attachment to an ATV.

The accessory shown best in FIG. 1 comprises a main frame member 30 which is in the form of a single beam in this embodiment which extends from a rear end 31 forwardly to a transverse bracket 32 at the forward end. The beam is formed in two portions 30A and 30B which are connected together with one inside the other and fastened at two spaced points be bolts 33 and 34. The outer member 30A has slots 35 so that the longitudinal position of the inner member 30B can be adjusted to adjust the length of the frame member from the rear end 31 to the forward end bracket 32. A hitch coupling 36 is provided at the rear end 31. The hitch coupling is fixed to the rear end by a bracket 37. The hitch coupling is shown as a screw 38 with a head 39 for screwing into a cooperating hitch mounting socket on the vehicle but it would be appreciated that the type and arrangement of the hitch can vary in accordance with the design provided by the manufacturer of the ATV. The hitch is however fixed relative to the rear end 31 of the frame member 11 so that the frame member is held fixed at the rear end by its engagement with hitch.

At the forward end behind the bracket 32 is provided a mounting plate 40. This mounting plate defines a flat horizontal top surface 41 with inclined side edges 42 which extends downwardly arid outwardly along the length of the plate 40. The plate 40 thus bridges the frame member 11 so it extends outwardly to each side of the frame member along side edges parallel to the frame member The mounting plate has down turned mounting flanges 44 each on a respective side of the beam 30 with the flanges 44 connected to side walls of the beams 30 by transverse bolt 45. The bolt 45 thus provides a single mounting point for the plate 40 underneath the plate 40 so that the plate can pivot front to rear about the single bolt 45 so the front edge can raise and lower slightly relative the rear edge to change angle of the plate relative to the upper surface of the beam 30.

On top of the top surface 41 is provided a resilient rubber layer 146 which is attached adhesively to the upper surface so as to provide a resilient layer to prevent metal on metal contact between the upper surface and the belly pan of the vehicle. The resilient layer can also take up any minor shaping of the belly pan or projecting below the belly pan of the frame tubes depending upon the specific design of the belly pan of make of ATV concerned.

The bracket 32 comprises a flat plate 46 welded to the end of the beam 30 at the forward end. Sides of the flat plate are bent forwardly to form a pair of flanges 47 which are parallel and spaced by distance greater than the width of the beam. A transverse pin 48 extends across between the flanges and carries for pivotal movement about the horizontal axis as a pin a stub frame portion 50 defined by am arm 51 and a housing 52.

The flanges 47 also provide mounting holes 53 for a pair of straps 54 and 55 which are arranged to support the forward end of the beam 30 as part of the mounting assembly 11. The straps 54 and 55 include conventional ratchet tensioning members 56 which can be operated to pull the straps tort. The straps can be varied in length independence upon the location of a suitable connecting portion such as the front bumper of the ATV. The straps are spaced apart one on either side of the beam 30 and extend upwardly from the beam and often slightly outwardly from the bracket so as to provide upward force from two spaced points tending to pull the beam 30 upwardly and thus the plate 40 upwardly underneath the belly pan of the ATV.

Thus the mounting assembly 11 defined by the lifting elements 54 and 55, by the mounting plate 40 and by the hitch coupling 36 provides a rigid mounting of the element on any manufacturer of ATV of the type which provides both a hitch and a belly pan. Surprisingly the arrangement can accommodate differences in design and location of the three mounting points that is the front structure to which the straps are attached, the belly pan and the hitch since these can vary significantly in spacing and height. However the arrangement as provided can mount suitably to each of the construction in a manner which provides a fixed mounting point define by the bracket 32 on to which the working tool 10 can be mounted.

The stub frame 50 pivotal about the pin 48 defined by the arm 51 and the housing 52 carries a blade 57 having a blade surface 58 for pushing material in front of the ATV.

The stub frame 50 includes the arm 51 which is coupled at its rear end to the pin 48 and extends there from in a first section which descends downwardly and forwardly as indicated at 59 to the height of a horizontal portion 60 which is therefore below the height of the beam 30. This horizontal portion 60 defines an insert into the housing 52. The housing 52 comprises a top plate 61 and a bottom plate 62 with two side plates 63. The housing is open at the rear end for insertion of the arm 51. The housing diverges from the rear opening 65 forwardly and outwardly to two lugs 66 and 67 which extend upwardly from the housing. At the side of the housing is formed a pivot bracket 68 for receiving the blade 57 for pivotal movement about a horizontal transverse axis. The blade is pulled rearwardly by a pair springs 69 which extend from the top of the blade to a suitable hook 66A on the lug 66, 67. This allows the blade to trip forwardly in the event of an impact with an obstacle by pivoting around the pivot axis so the bottom edge of the blade can move rearwardly as the blade tips so its top edge moves forwardly.

The housing 52 is mounted on the front end of the horizontal portion 60 of the arm 51 by a pivot pin 70 which extends through the housing and through the arm to hold the elements coupled at this position. In this way the housing can pivot side to side about the pin 70 so that its rear edge at the open mouth 65 moves side to side thus twisting the blade about the pivot axis defined by the pin 70.

In the embodiment shown in FIG. 1, the position of the housing relative to the arm is controlled by a conventional spring pin which inserts into one of plurality if holes 72 in the top wall 61 of the housing. The spring pin is thus carried on a housing mounted on the arm 50 which extends through an opening 73 in the top wall 61 of the housing with the pin projecting rearwardly over a series of the holes 72 lying in an arch around the axis of the pin 70.

In this way the angle of the blade can be moved from a straight a head position in which the blade is directly transverse to a center line of the vehicle or can be moved to various selected angles inclined to the left or to the right as required and as is common in blade arrangements of this type.

The blade 57 thus includes the blade wall 58 together with a plurality of flanges 75 at spaced positions along the blade wall on the rear of the blade wall and extending at right angles to the blade wall. These flanges thus provide stiffening for the blade wall in conventional manner. Two inner ones of the flanges are arranged at the outside edges of the housing 52 so as to provide the pivot point for the blade. The two outer ones of the flanges which are arranged adjacent to but spaced inwardly from the outside edge 76 of the blade wall 58 are arranged to carry mounting feet 77 which can be used to support the structure when separated from the vehicle.

The blade structure including the stub frame 50 is freely pivotal about the pin 48 so that it can be moved upwardly and downwardly as required. The height of the blade and the stub frame are controlled by a cable 78 which extends from the winch 25 to a loop 79 suitable located on the arrangement and in the embodiment shown attached to the pin 70. Thus operation of the winch under the control of the rider of the vehicle can raise and lower the blade to the required height.

Figure 3:
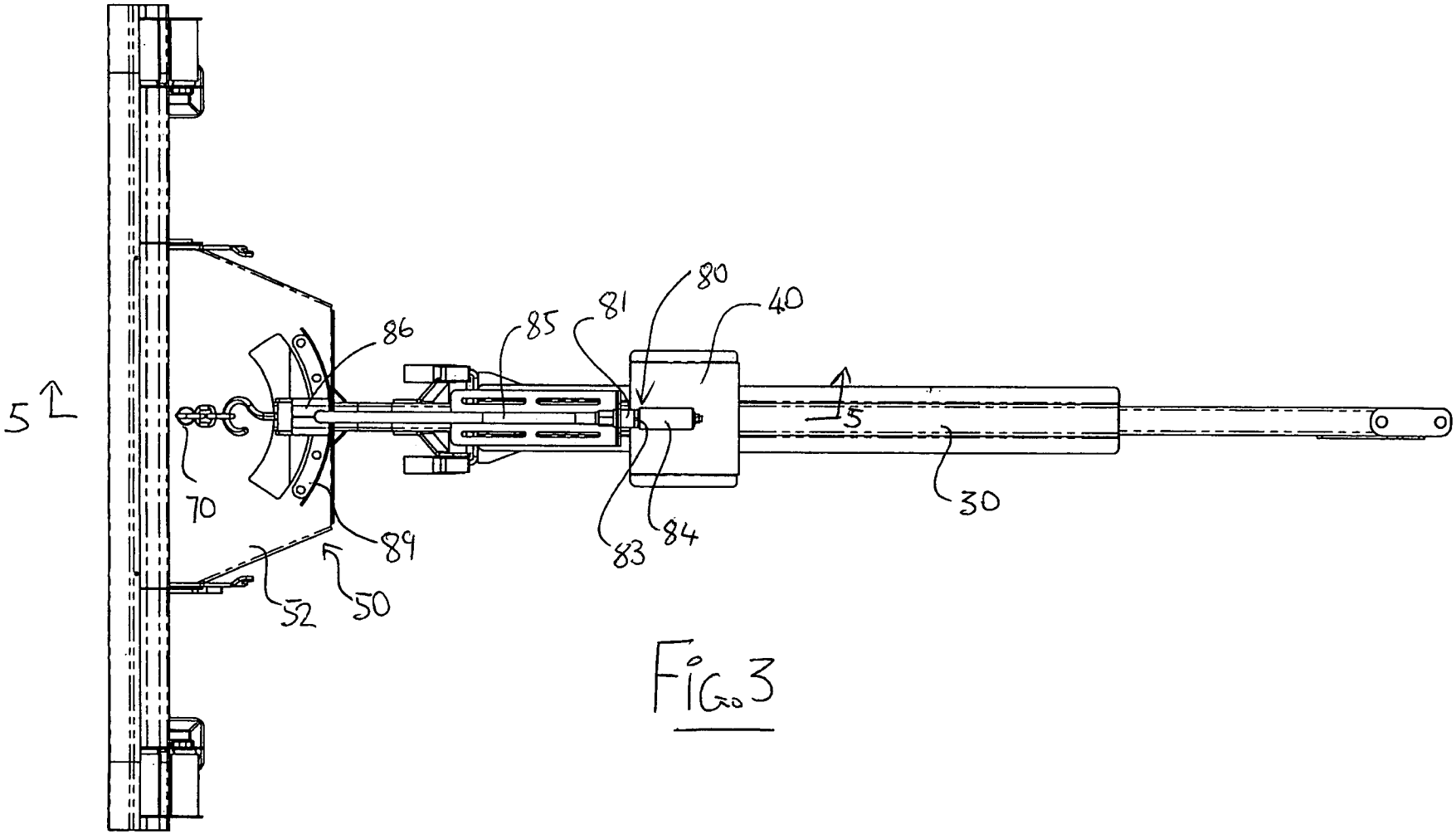
FIG. 3 is a top plan view of the accessory of FIG. 1 including a manually operable screw for actuating movement of the blade.
Figure 4:
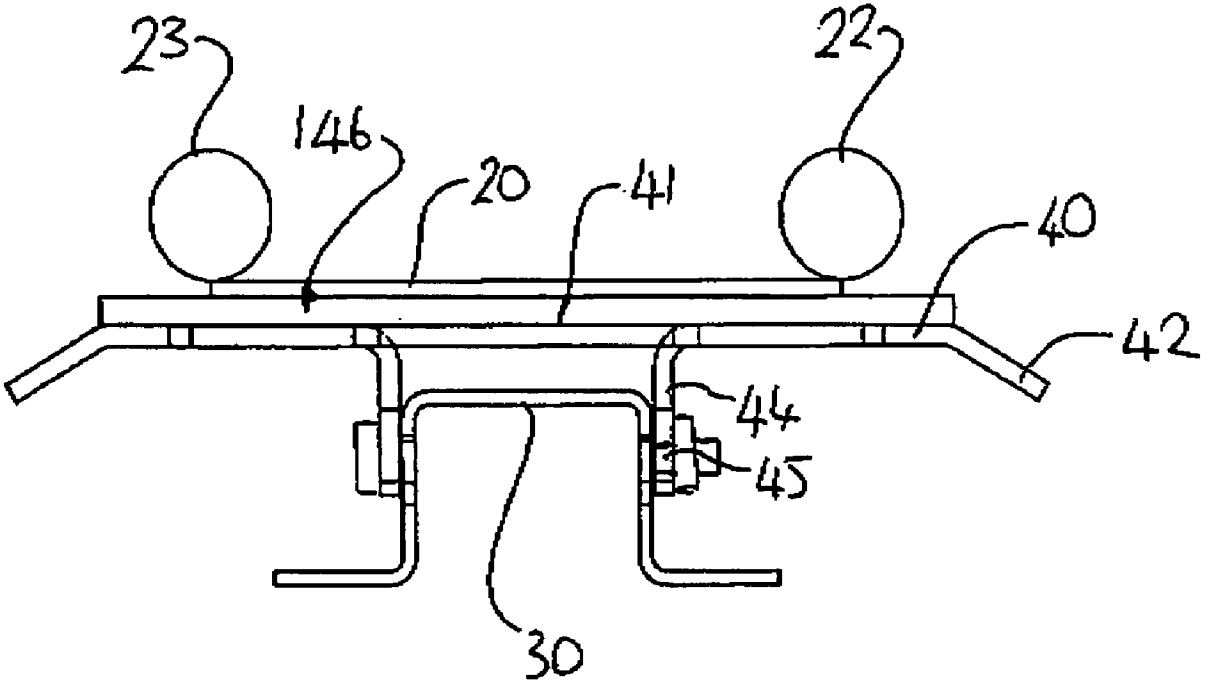
FIG. 4 is a view along the lines 4—4 of FIG. 2 showing the engagement of the mounting plate with the belly pan of the ATV.
Figure 5:
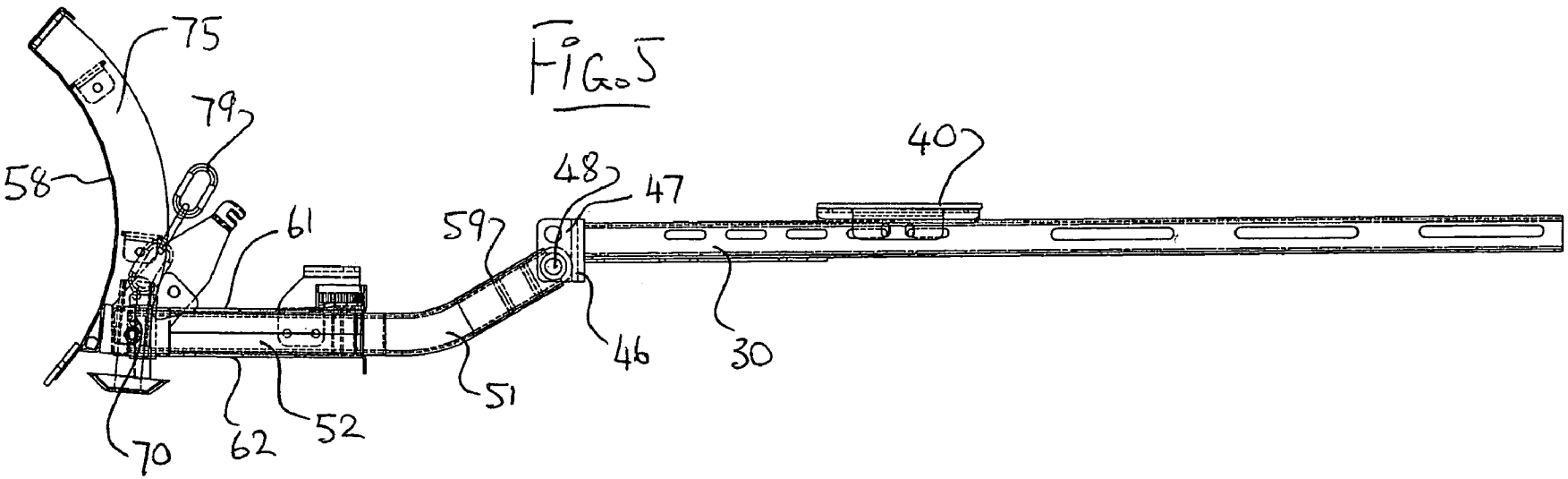
FIG. 5 is a cross-sectional view of the forward part of the accessory of FIG. 1.

In one arrangement (not shown) the angle of the blade is adjusted by pulling the pin and by manually moving the blade to one side or the other. In FIGS. 1 and 3 is shown an alternative arrangement in which the angle of the blade is rotated around the axis of the pin 70 by a manually operable drive mechanism generally indicated at 80. This includes a housing 81 with a mounting clamp 82 by which the housing can be mounted on a suitable location such as the handle bars or front carrier frame of the vehicle. The housing attaches a screw 83 which can be rotated manually by a handle 84 around an axis of the housing 81. A rear end of the crank is attached to a flexible torque member 85 which can transfer rotational movement of the crank through the length of the torque member to a drive 86 carried on the arm 51. The drive 86 comprises a mounting element together with a driven shaft one end of which is attached to the torque member 85 and the other end of which carries a gear wheel. A rack 89 is mounted on the top wail of the housing with an arch around the axis of the pin 70 so that the gear wheel when rotated in one direction or the other drives the housing relative to the arm to effect pivotal movement of the blade around the axis of the pin 70. Thus the hand crank 83 and its handle 84 can be fixedly positioned at a suitable location for operation by the rider so that the rider without dismounting can provide the cranking action which drives the blade to the required location. The torque member 85 can be any elongate member which is resistant to twisting so that rotation at one end is communicated through to the other end. One suitable arrangement is in the form of hydraulic hose which has metal braiding conventionally to resist internal pressure but in this embodiment used to resist twisting.

Figure 6A:
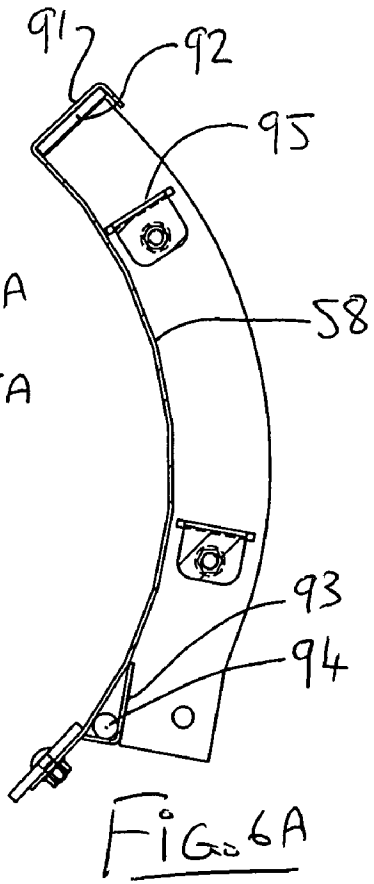
FIG. 6A is a cross sectional view through the junction between the main blade section and one of the extension pieces.
Figure 6:
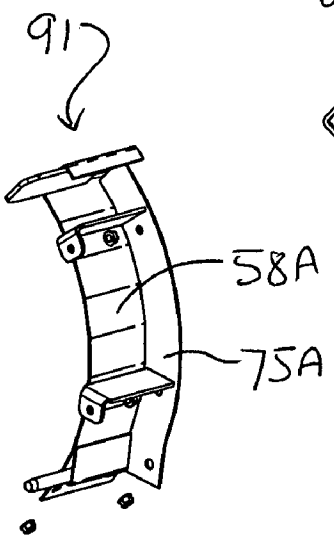
FIG. 6 is an exploded view of the blade only of the embodiment of FIG. 1 showing extension pieces which can be added to the main body of the blade.
Figure 6:
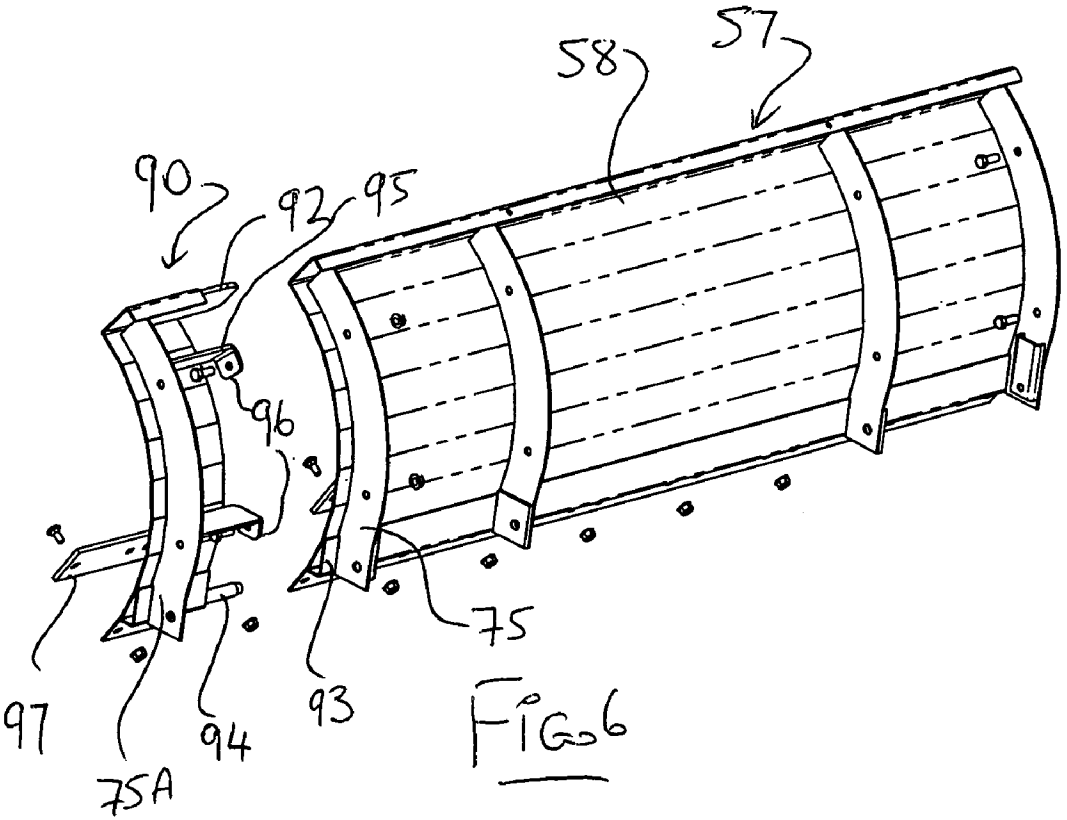

Turning now to FIG. 6, the blade is shown separated from the support and including a pair of blade extension pieces 90 and 91 for mounting on the blade 57. Each of the extension pieces comprises an extension wall piece 58A matching the wall 58 in side and curvature but of course of narrow width relative to the wide width of the main blade portion. In addition the extension piece includes a flange 75A corresponding to the flanges 75 of the main blade section.

At the top of the main blade section is a flange portion 91 which defines a channel for receiving a projecting piece 92 of the extension piece 90 when it is brought up to the end of the main blade and moved longitudinally along the main blade to provide an assembling action. Symmetrically at the bottom of the blade wall 58 is provided a tube 93 which receives a pin 94 at the bottom of the extension piece wall so that these two pieces can slide into engagement to hold the extension piece attached to the end of the main blades section. The elements are fixed in place by a bracket 95 which is attached along the rear of the wall 58A and provides an end flange 96 which bolts to the flange 75 which is located just inward of the end edge of the main blade portion. A second bracket 95 is located at a position adjacent the lower edge of the extension piece 90. The end flange 96 is located beyond the edge of the extension piece so that it butts against the side wall of the flange 75.

A wear plate 97 is arranged to be attached to the bottom edge of the blade at the extension piece and at the main blade portion. When the extension pieces are attached, a wear plate 97 is used which is longer than the extension portion and therefore extends onto the main blade and thus assists in maintaining the attachment between the main blade and the extension piece thus providing integrity across the bottom edge of the blade both through the main blade portion and the extension pieces during the scrapping action over the ground.

Figure 7:
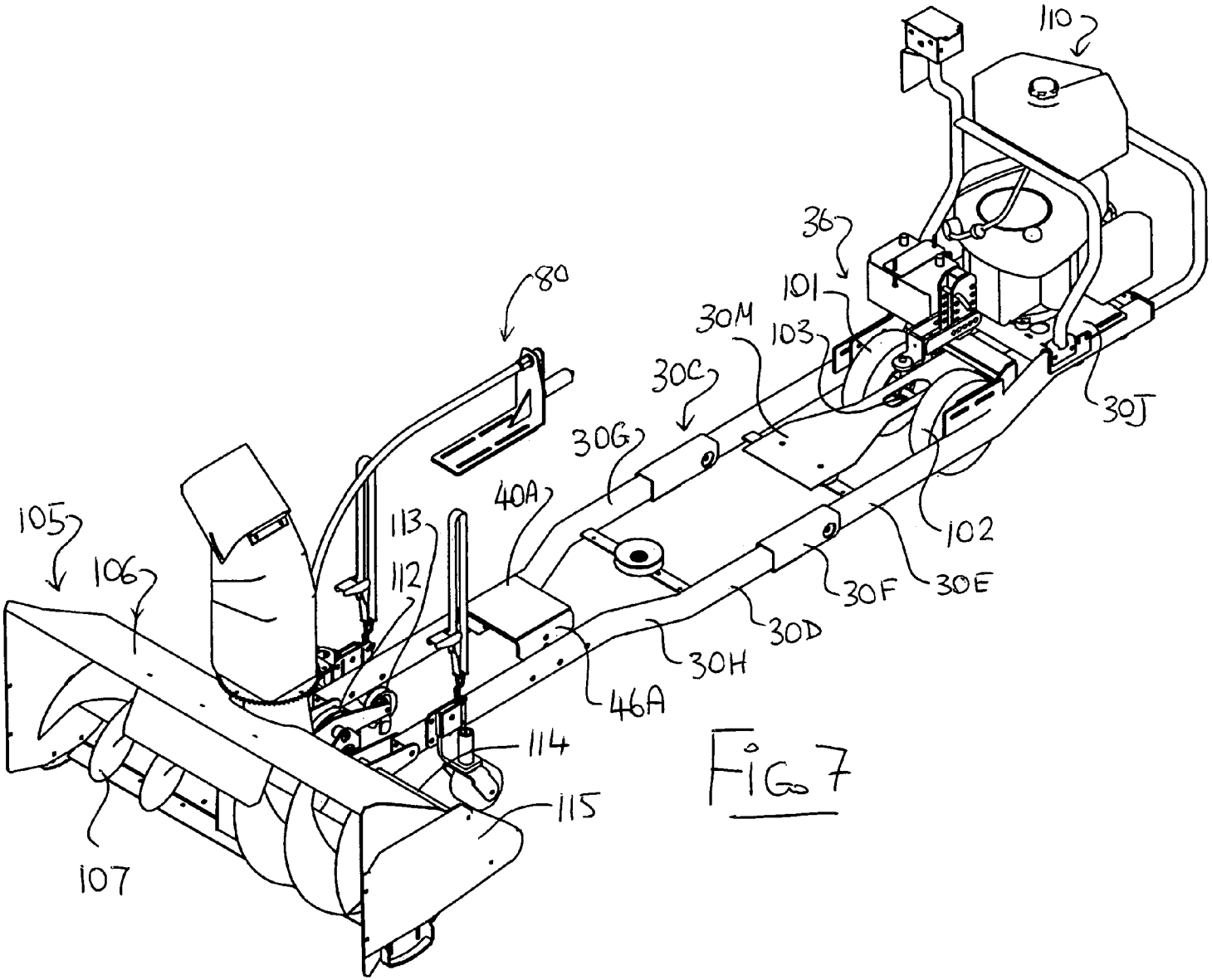
FIG. 7 is an isometric view of a snow blower accessory and mounting arrangement for attachment to an ATV.
Figure 8:
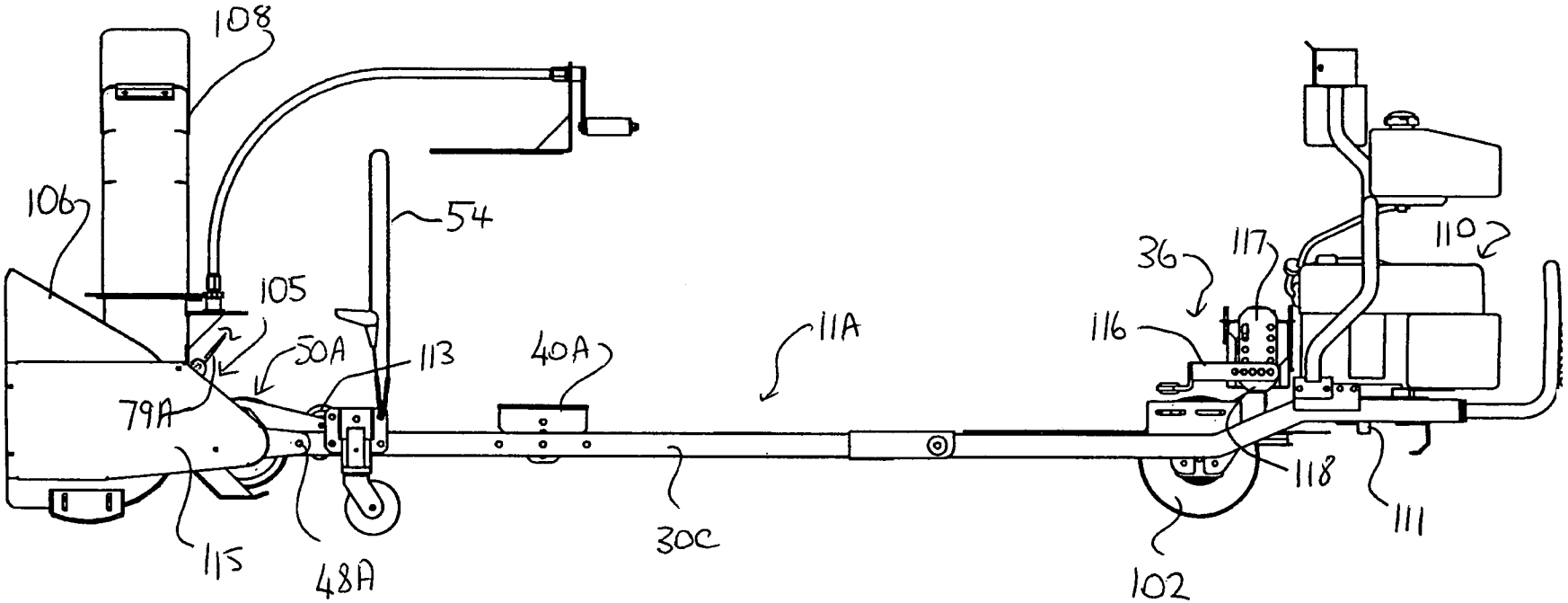
FIG. 8 is a side elevational view of the embodiment of FIG. 7.

Turning now to FIGS. 7 and 8, there is shown an accessory for attachment to an ATV which uses many of the principles of the embodiment described above. Thus the mounting assembly generally indicated at 11A includes a frame member 30C which is formed in two sections 30D and 30E connected together at an adjustment coupling 30F. In this embodiment however the frame member 30C is formed as two generally parallel horizontally spaced beams 30G and 30H which extend forwardly from a transverse connection plate 30J to the mounting plate 40*a* which is substantially as previously described. In this arrangement, however, the plate 40A spans the space between the two beams 30G and 30H and has its flanges 46A attached to the inside surface of the beams 30G and 30H. The beams are also connected additional transverse stiffening elements 30K and 30L and a base plate 30M is provided which extends forwardly from the transverse plate 30J to a position underlying the rear axle or between the rear wheels of the ATV.

In this embodiment there are provided a pair of wheels 101 and 102 which are located on an axle 103 between the beams 30G and 30H end spaced apart either side of the plate 30M.

In this embodiment the lifting element or straps 54 are located one on each of the beams 30G and 30H. The straps are again located at the forward end of the beams.

In this embodiment the working tool is in the form of a snow blower 105 of conventional construction. This includes a shroud 106 containing an auger flight 107 which conveys snow from the shroud to a discharge duct 108. The snow blower itself is of a conventional construction. The snow blower is mounted rigidly on a stub frame 50A defined by arms 50B which are rigidly attached to the rear of the shroud 106 and extend rearwardly to a pivot pin 48A at the forward end of the beams 30G and 30H. Again the height of the working tool the blower is controlled by the winch with a cable 78A which extends to a suitable connection point on the shroud or on the frame. Thus again the forward end of the frame 11A defines a fixed point with the frame 11A attached to the vehicle rigidly by the coupling arrangement previously described so that the working tool can pivot upwardly and downwardly on the front of the frame in a working action.

In this embodiment a motor generally indicated at 110 is mounted at the rear of the frame on the transverse plate 30J. The motor is of a conventional nature and drives a pulley 111 at the bottom of the motor underneath the plate 30J. The pulley 111 drives a belt (not shown) which extends along the frame between the beams 30G and 30H to a drive pulley 112 of the working tool or snow blower. The belt twists through ninety degrees in its movement along the frame and passes over an idler pulley 113 in its path onto and around the drive pulley 112 of the snow blower. The drive pulley drives a suitable drive connection in the form of a shaft 114 which extends along the shroud behind the shroud to a gear box contained within a housing 115 at the end of the shroud for driving the auger 107.

As the frame sits on the ground wheels 101 and 102 at all times so that the weight at the rear of the frame is carried by the ground wheels rather than by the vehicle, the hitch coupling 36 is designed to float. Thus the actual connection point to the hitch 27 of the vehicle is rigidly attached to the vehicle but is carried on an arm 116 which can move upwardly and downwardly relative to the frame 30C. For this purpose the arm 116 is carried on a housing 117 which floats upwardly and downwardly on a post 118 attached to the frame.

In this way the frame is held against side to side movement and is propelled forwardly by its connection to the vehicle. However some slight upward and downward movement of the frame relative to the vehicle at the rear of the vehicle can occur due to changes in ground height and the fact that the frame is carried on the wheels which are different wheels from the wheels of the vehicle. The wheels 101 and 102 are moved as far forward as possible so that they are immediately under the hitch and close to the rear axle of the vehicle. In this way there is very little cantilever effect beyond the rear of the vehicle since the wheels lie on a line which is only just behind the transverse line defining the main axle of the vehicle. Thus the wheels of the vehicle and the wheels of the frame tend to move upwardly and downwardly on the same portion of the ground. Thus the engine 110 is canti-levered out behind the wheels. Due to this geometry of the structure moving the wheels 101 and 102 as far forward as possible, there is only a limited amount of relative movement between the vehicle and the frame and this can be accommodated by a slight twisting movement of the mounting plate 40 relative to the frame and/or by a slight twisting of the frame in the area behind the mounting plate. In this embodiment, therefore, the rigid mounting is achieved by pulling upwardly on the lifting elements 54 which pulls the mounting plate 40A underneath the belly pan of the vehicle and this torque is resisted by the engagement of the rear wheels on the ground. However this arrangement acts to effectively attach the frame to the vehicle for movement there with during forward movement and during steering action.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a working member attached at the forward end of the frame member so as to be at least partly supported thereby in front of the vehicle for operating in a working action in front of the vehicle;

a hitch coupling, at the rearward end of the frame member for attachment to the hitch;

a mounting plate for engaging the belly pan;

a lifting arrangement attached to the frame member in front of the mounting plate and including coupling members thereon for engaging a fixed location on the vehicle at a position thereon at the front thereof and above the mounting plate and lifting elements for applying a pulling force from the coupling members to the frame member to pressure the mounting plate against the belly pan.

2. The accessory according to claim 1 wherein the mounting plate is fixed to the frame member against side to side tilting movement relative thereto and the mounting plate is arranged to engage the belly pan at least two transversely spaced locations to prevent side to side twisting of the frame member.

3. The accessory according to claim 1 wherein the lifting arrangement includes two transversely spaced lifting elements each having a respective coupling member and each arranged on a respective side of the mounting plate.

4. The accessory according to claim 1 wherein the lifting elements comprise straps.

5. The accessory according to claim 1 wherein the mounting plate is adjustable fore and aft along the frame member.

6. The accessory according to claim 1 wherein the mounting plate is mounted on the frame member such that the mounting plate can tilt about transverse axis.

7. The accessory according to claim 1 wherein the mounting plate carries a resilient pad on its upper surface.

8. The accessory according to claim 1 wherein the mounting plate has a flat upper surface.

9. The accessory according to claim 1 wherein the frame member at its rear end is supported on ground wheels such the height of the rear end changes relative to the belly pan as the ground height changes.

10. The accessory according to claim 1 wherein the working member is carried on a stub frame portion which is pivotally attached to the frame member for pivotal movement about a transverse axis so as to provide upward and downward movement of the whole of the working member relative to the frame member.

11. The accessory according to claim 10 wherein there is provided a coupling on the working member for attachment to a cable of a winch of the vehicle for supporting the working member at a required height.

12. An all terrain vehicle having a working accessory mounted thereon comprising:

a vehicle having a frame, two front wheels and two rear wheels connected to the frame for supporting the frame in movement over the ground;

an engine mounted an the frame generally between the front and rear wheels and along a center line of the vehicle;

a belly pan attached to the frame and extending from a position underneath the engine forwardly to a front end of the vehicle for protecting the engine against impact damage;

and an accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a working member attached at the forward end of the frame member so as to be at least partly supported thereby in front of the vehicle for operating in a working action in front of the vehicle;

a hitch coupling at the rearward end of the frame member for attachment to the hitch;

a mounting plate for engaging the belly pan;

a lifting arrangement attached to the frame member in front of the mounting plate and including coupling members thereon for engaging a fixed location on the vehicle at a position thereon at the front thereof and above the mounting plate and lifting elements for applying a pulling force from the coupling members to the frame member to pressure the mounting plate against the belly pan.

13. An accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a transverse blade attached at the forward end of the frame member so as to be at least partly supported thereby in front of the vehicle for operating in a working action in front of the vehicle;

a coupling at the rearward end of the frame member for attachment to the vehicle;

a mounting assembly for fixedly mounting the frame member on the vehicle at a position forwardly of the rear end such that the forward end of the frame member is fixed relative to the vehicle;

a stub frame portion extending forwardly from the frame member for supporting the blade;

a housing attached to a rear of the blade, the housing having a top plate and a parallel bottom plate with the stub frame portion located therebetween;

a forward end of the stub frame portion being pivotally connected to a forward end of the housing for pivotal movement of the bade in a side to side direction to change an angle of the blade relative to a direction along a center line of the vehicle;

a rear end of the housing having mounted thereon an adjustment mechanism for locating the rear end of the housing relative to the stub frame portion to set the angle of the blade.

14. The accessory according to claim 13 wherein the stub frame portion is pivotal relative to the frame member about a horizontal transverse axis.

15. The accessory according to claim 14 wherein there is provided a coupling on one of the blade and the housing for attachment to a cable of a winch of the vehicle for supporting the blade at a required height.

16. The accessory according to claim 13 wherein the stub frame portion includes a rear section which is inclined downwardly and forwardly such that the housing is lower than the frame member.

17. The accessory according to claim 13 wherein the adjustment mechanism includes a screw which is operable by the rider of the vehicle and a gear drive for driving the pivotal movement of the housing relative to the stub frame portion.

18. An accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising;

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a transverse blade attached at the forward end of the frame member so as to be at least partly supported thereby in front of the vehicle for operating in a working action in front of the vehicle;

a coupling at the rearward end of the frame member for attachment to the vehicle;

a mounting assembly for fixedly mounting the frame member on the vehicle at a position forwardly of the rear end such that the forward end of the frame member is fixed relative to the vehicle;

and a pair of extension pieces each for attachment to a respective end of the blade so as to extend outwardly from the respective end of the blade and defining a common surface with the blade.

19. The accessory according to claim 18 wherein each extension piece has a top insert and a bottom insert which can slide into a corresponding receptacle on the end of the blade when moved along the common surface.

20. The accessory according to claim 18 wherein there is provided at each end of the blade a flange at right angles to the common surface and spaced inwardly from the edge of the blade and wherein each extension piece includes a mounting bracket projecting inwardly from the extension piece along the back of the blade for attachment to the respective flange.

21. The accessory according to claim 18 wherein there is provided a wear plate at a bottom edge of the blade and wherein each extension piece includes a wear plate which has a length greater than that of the extension piece so as to overlap onto the blade.

22. An accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle from a forward end of the frame member which is arranged to project forwardly from the front end of the vehicle to a rearward end of the frame member which is arranged to project rearwardly from the rear end of the vehicle;

a working member attached at the forward end of the frame member so as to be at least partly supported thereby in front of the vehicle for operating in a working action in front of the vehicle;

a coupling at the rearward end of the frame member for attachment to the vehicle;

a mounting assembly for fixedly mounting the frame member on the vehicle at a position forwardly of the rear end such that the forward end of the frame member is fixed relative to the vehicle;

the working member being mounted for adjustment movement relative to the frame member;

and an adjustment actuating assembly for actuating movement of the working member comprising:

a screw having a screw mounting for mounting the screw on a part of the vehicle accessible by the rider of the vehicle so as to be manually rotatable by a rider;

an elongate torque member having a first end connected to the screw for communicating rotation from the screw into rotation around a longitudinal axis of the torque member;

and an actuator attached to a second end of the torque member so as to receive the rotation and to actuate the adjustment movement in response thereto.

23. The accessory according to claim 22 wherein the actuator includes a gear wheel driven by the torque member and a driven member driven about its axis by the gear wheel.

24. The accessory according to claim 22 wherein the working member comprises a blade and the actuator adjusts the angle of the blade to the longitudinal center line of the vehicle using a gear drive.

25. The accessory according to claim 22 wherein the working member comprises a snow blower and the actuator adjusts the angular position of a discharge chute of the snow blower around a vertical axis.

26. An accessory for mounting on an all terrain vehicle, the vehicle having a frame, two front wheels and two rear wheels connected to the frame for supporting the frame in movement over the ground, an engine mounted on the frame generally between the front and rear wheels and along a center line of the vehicle, a belly pan attached to the frame and extending from a position underneath the engine forwardly to a front end of the vehicle for protecting the engine against impact damage and a hitch at the rear of the frame;

the accessory comprising:

a frame member which is shaped and arranged to extend longitudinally of the vehicle underneath the vehicle to a rearward end of the frame member which is arranged to project rearwardly from the rear end of the vehicle;

a working member attached to the frame member so as to be at least partly supported thereby for operating In a working action with the vehicle;

a mounting assembly for attaching the frame member and the working member on the vehicle at a position forwardly of the rear end such that the forward end of the frame member is fixed relative to the vehicle;

at least one ground wheel on the frame member arranged so as to support the rear end of the frame member from the ground such that the height of the frame member varies relative to the hitch of the vehicle as the ground level changes;

and a hitch coupling at the rearward end of the frame member for attachment to the hitch of the vehicle;

the hitch coupling being adjustable such that the height thereof from the frame member can be adjusted;

and the hitch coupling being arranged to float such that the hitch coupling remains attached to the hitch to provide pulling force thereon while the frame member varies in height relative to the hitch as the ground level changes.

27. The accessory according to claim 26 wherein the at least one ground wheel is located substantially directly under the hitch coupling and forward of the rear end of the frame member.

28. The accessory according to claim 26 wherein there is provided a drive engine mounted on the rear end for driving the working member.

29. The accessory according to claim 26 wherein there are a pair of wheels.

30. The accessory according to claim 26 wherein the frame member is defined by a pair of parallel beams and wherein the wheels are located side by side between the beams.

* * * * *